US005754201A

United States Patent [19]

Ishinaga et al.

[11] Patent Number: 5,754,201

[45] Date of Patent: May 19, 1998

[54] LIQUID JET HEAD, HEAD CARTRIDGE, LIQUID JET APPARATUS, METHOD OF EJECTING LIQUID, AND METHOD OF INJECTING INK

[75] Inventors: Hiroyuki Ishinaga, Tokyo; Masami Ikeda, Yokohama; Hajime Kaneko, Kodaira; Jun Kawai, Tokyo; Yasutoshi Saito; Masaaki Izumida, both of Kawasaki; Masahiko Tonogaki, Tokyo, all of Japan

[73] Assignee: Canon Kabushiki Kaisha, Tokyo, Japan

[21] Appl. No.: 544,597

[22] Filed: Oct. 18, 1995

[30] Foreign Application Priority Data

Oct. 20, 1994 [JP] Japan ..... 6-255248
Oct. 3, 1995 [JP] Japan ..... 7-256347

[51] Int. Cl.[6] ..... B41J 2/05

[52] U.S. Cl. ..... 347/62

[58] Field of Search ..... 347/62, 63, 65, 347/68, 9, 12, 13

[56] References Cited

U.S. PATENT DOCUMENTS

| | | | |
|---|---|---|---|
| 4,251,824 | 2/1981 | Hara et al. . | |
| 4,463,359 | 7/1984 | Ayata et al. | 347/56 |
| 4,558,333 | 12/1985 | Sugitani et al. . | |
| 4,568,953 | 2/1986 | Aoki et al. . | |
| 4,611,219 | 9/1986 | Sugitani et al. . | |
| 4,646,110 | 2/1987 | Ikeda et al. . | |
| 4,881,318 | 11/1989 | Komuro et al. . | |
| 5,148,192 | 9/1992 | Izumida et al. . | |
| 5,175,565 | 12/1992 | Ishinaga et al. . | |
| 5,371,528 | 12/1994 | Izumida et al. . | |
| 5,485,186 | 1/1996 | Ishinaga et al. | 347/65 |
| 5,559,543 | 9/1996 | Komuro | 347/62 |

FOREIGN PATENT DOCUMENTS

| | | |
|---|---|---|
| 0124312 | 11/1984 | European Pat. Off. . |
| 0613781 | 9/1994 | European Pat. Off. . |
| 55-132259 | 10/1980 | Japan . |
| 62-261452 | 11/1987 | Japan . |
| 1-235652 | 9/1989 | Japan . |
| 2-239940 | 9/1990 | Japan . |

*Primary Examiner*—Edward Tso
*Attorney, Agent, or Firm*—Fitzpatrick, Cella, Harper & Scinto

[57] ABSTRACT

An ink jet head having a plurality of electrothermal transducer elements in one liquid passage is arranged so that the ratio of the areas of two of the plurality of electrothermal transducer elements is smaller than the ratio of the amounts of ink ejected by the two electrothermal transducer elements, thereby stably obtaining the desired amounts of ejected ink and achieving a high gradational effect at a high energy efficiency.

14 Claims, 10 Drawing Sheets

SECTION ALONG A-A

| SMALL HEATER | LARGE HEATER |
|---|---|
| OFF | OFF |
| AMOUNT EJECTED = 0ng | |

| SMALL HEATER | LARGE HEATER |
|---|---|
| ON | OFF |
| AMOUNT EJECTED = 30ng | |

| SMALL HEATER | LARGE HEATER |
|---|---|
| OFF | ON |
| AMOUNT EJECTED = 60ng | |

| SMALL HEATER | LARGE HEATER |
|---|---|
| N | ON |
| AMOUNT EJECTED = 90ng | |

LIQUID JET HEAD, HEAD CARTRIDGE, LIQUID JET APPARATUS, METHOD OF EJECTING LIQUID, AND METHOD OF INJECTING INK

BACKGROUND OF THE INVENTION

1. Field of the Invention

The present invention relates to an ink jet recording head and an ink jet recording apparatus for use in a copying machine, a facsimile machine, a word processor, a printer provided as an output terminal of a host computer, a video printer or the like and, more particularly, to an ink jet recording head and an ink jet recording apparatus having an element substrate on which electrothermal transducer elements for generating thermal energy for recording are formed. "Recording", as used hereinafter, refers to a process including applying (printing) ink to an ink supporting member in the form of a sheet or any other form, e.g., cloth, string or paper. Recording apparatuses to which the present invention can be applied are various kinds of information processors or printers provided as output devices of such processors.

2. Description of the Related Art

Recently, in the field of ink jet recording, demand for recording apparatuses capable of multi-color recording and high-quality recording has been increased as well as demand for smaller or low-priced recording apparatuses. Conventionally, it is necessary for a recording head to be constructed and controlled precisely in a complicated manner in order to realize high quality recording. For this reason, conventional recording apparatuses are very high-priced and are large in size.

Japanese Patent Laid-Open Publication No. 132259/1980 discloses a very simple arrangement in which the dot size is changed by at least two electrothermal transducer elements (which include the case of differing from each other in size) provided in one nozzle to obtain a high gradational effect and high image qualities. This art is very important as a means for multi-value recording.

To set a desired amount of ink ejected from a recording head of the type having one electrothermal transducer element provided in one nozzle, the recording head is ordinarily designed by specially considering the area of a heating region of the electrothermal transducer element and the shape of the nozzle (in particular, the ejection opening area, the length and the sectional area of the nozzle).

It is known that, in such a head, the amount of ejected ink (hereinafter referred to as "ejection amount") is approximately proportional to the area of the heating region of the electrothermal transducer element. It is also known that the electrothermal transducer element, made on an element substrate along with wiring conductors, is difficult to reform in comparison with the nozzle (liquid passage) in the manufacturing process. For designing heads of the type having one electrothermal transducer element provided in one nozzle, therefore, a method has been adopted in which the area of the heating region of the electrothermal transducer element is determined to roughly set the ejection amount to a desired value, and in which the ejection opening area, the size of which can be easily adjusted by working, is thereafter changed slightly to adjust the ejection amount more accurately.

In a head having the amount of ejection from one nozzle changed by using a plurality of electrothermal transducer elements provided in the nozzle, a difference between the amounts of ejection by the electrothermal transducer elements due to a difference between the distances from centroids of heating regions of the electrothermal transducer elements to the position at which an ejection opening is formed (to the ejection opening surface) is negligible if the difference between the distances is very small.

The inventors of the present invention therefore practiced a design for a head having a plurality of electrothermal transducer elements provided in one nozzle. In this design, to determine the ejection amount, the proportional relationship between the ejection amount and the area of the heating region of the electrothermal transducer element in the above-described head having one electrothermal transducer element in one nozzle was also utilized, that is, the ratio of the areas of heating regions of two of the plurality of electrothermal transducer elements was determined to roughly set the amounts of ejection by the plurality of electrothermal transducer elements to desired values assuming that the ratio of the desired ejection amounts was equal to the ratio of the areas of the heating regions. Then, heads having the orifice area slightly varied were manufactured by way of experiment to adjust the ejection amounts more accurately. However, it was found that, if the above-mentioned recording head is designed on the basis of this design conception, the ejection amounts can be set to desired values with a certain degree of accuracy, but it is difficult to adjust the ink ejection amounts so as to obtain desired gradations when the amounts of ejection by the plurality of electrothermal transducer elements are to be adjusted more accurately to satisfy conditions for high image qualities, a high gradational effect, high resolution, a small ejection amount and a high energy efficiency, which are now in demand. This may be because the ratio of the areas of the heating regions of two of the plurality of electrothermal transducer elements provided in one nozzle is not always equal to the ratio of the ejection amounts, and because the latter ratio is affected by a compositive effect of other factors.

As described above, to obtain a head having a plurality of electrothermal transducer elements in one nozzle, steps of trial manufacture are repeated until the ratio of ejection amounts for obtaining accurate gradations is obtained. It is possible that the manufacturing efficiency may be reduced thereby.

SUMMARY OF THE INVENTION

In view of the above-described problem, an object of the present invention is to provide a recording head capable of achieving suitable gradations.

The inventors of the present invention made studies to determine conditions for required stable ejection characteristics of a plurality of electrothermal transducer elements provided to set different ejection amounts, and found that a high gradational effect and a high energy efficiency can be achieved by setting the ratio of required amounts of ejection from two electrothermal transducer elements in a certain relationship with the ratio of the areas of heating regions of the electrothermal transducer elements (preferably, also with the size and the shape of the electrothermal transducer elements) in the above-mentioned head design.

Therefore, another object of the present invention is to determine this relationship so that suitable gradations can be obtained at a high energy efficiency.

Still another object of the present invention is to stably obtain ejection amounts for desired gradations by using the above-mentioned electrothermal transducer elements.

It has been found that, in electrothermal transducer element, there are both a heating region which contributes to the generation of ejection energy effective in actually ejecting ink (the generation of a bubble in a liquid) and another heating region which is not utilized to directly generate such ejection energy (or does not contribute directly to the generation of a bubble in the liquid). This is because a certain temperature distribution occurs in a heating region of the electrothermal transducer element during heating. A peripheral portion of the heating region is defined as a non-bubble-generating region having a temperature lower than that of a central portion of the heating region and lower than a temperature at which ink is heated to generate a bubble therein. Accordingly, the peripheral portion does not contribute directly to the generation of ejection energy. On the other hand, in the heating region, a bubble generating region through which a bubble is generated in ink is defined. A plurality of electrothermal transducer elements in one nozzle have been designed on the basis of this conception by a method described below to obtain desired ejection amounts with desired stability.

First, when the ratio of the amounts of ejection by two of the electrothermal transducer elements is to be set to a certain value, a design of setting the ratio of the areas of heating regions of the electrothermal transducer elements to a value slightly smaller than that of the ejection amount ratio is effective.

Second, it is more preferable to design the electrothermal transducer elements so that the ratio of the amounts of ejection by the electrothermal transducer elements to be set is equal to the ratio of values obtained by subtracting 0.1 to 10 μm from the widths of the heating regions of the electrothermal transducer elements.

Third, more preferably, the ratio of the amounts of ejection by the electrothermal transducer elements and the ratio of effective bubble generating areas of the electrothermal transducer elements are approximately equal to each other.

Fourth, the above-mentioned effective bubble generating area of each electrothermal transducer element is determined by subtracting an area of 1 to 10 μm from the periphery of the entire area of the electrothermal transducer element.

The above-described condition of the present invention is particularly desirable when the distances of the centroid positions of the heating regions of the electrothermal transducer elements from the position at which the ejection opening is formed are approximately equal to each other (the error is not larger than a manufacturing variation of about 3 μm), and when the materials, the film thicknesses and drive conditions with respect to applied pulses or the like of the electrothermal transducer elements are substantially equal to each other. Conversely, if the nozzle and the electrothermal transducer elements are designed by this method, desired ejection amounts can be obtained without finely controlling the amount of ejection from each electrothermal transducer element through a drive condition or the like.

If the ejection amount ratio can be determined by such a simple method, a higher gradational effect can be obtained for gradation expression of an image. This effect is very important.

These and other objects, features and advantages of the present invention will become apparent from the following detailed description of the invention with reference to the accompanying drawings.

DESCRIPTION OF THE PREFERRED EMBODIMENTS

An ink jet head in accordance with the present invention will be described below with reference to the accompanying drawings.

Any liquid other than a recording liquid such as ink used for recording may be used in examples of the ink jet head of the present invention described below as long as the ink jet head can operate with the liquid.

(Example 1)

Figure 1:
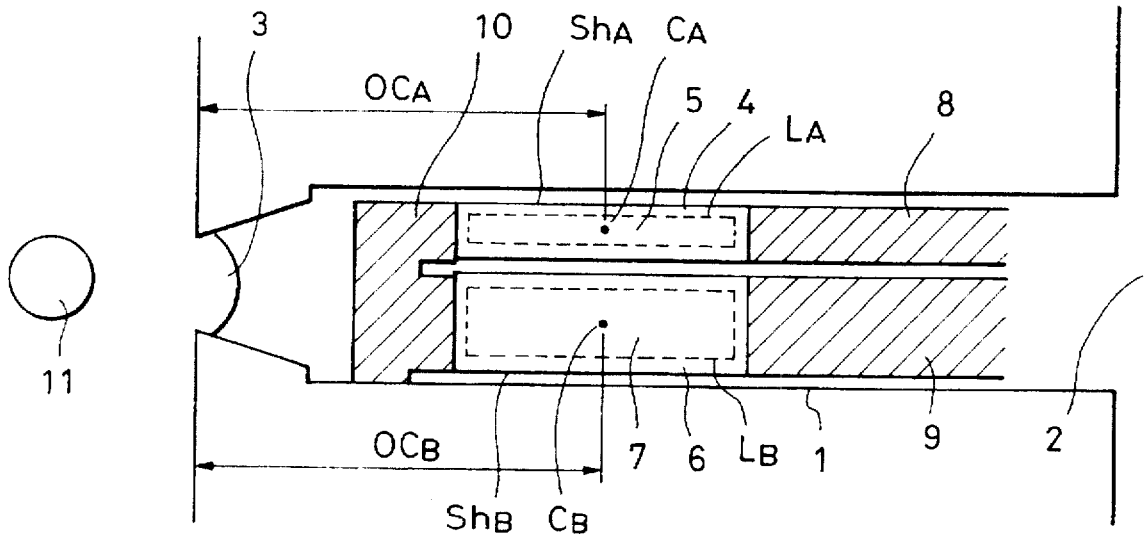
FIG. 1 is a schematic diagram showing the configurations of a liquid flow passage and electrothermal transducer elements in accordance with the present invention.

FIG. 1 is a schematic sectional view of the configurations of a liquid flow passage and electrothermal transducer elements of a liquid jet head in accordance with the present invention, in which the liquid flow passage is seen from the side opposite from the electrothermal transducer elements.

A liquid flow passage 1 communicates with a liquid chamber 2, and a meniscus 3 is formed in the liquid flow passage (nozzle) in the vicinity of an orifice (ejection opening) by a capillary force. At least two electrothermal transducer elements may be provided in the nozzle. However, an example of an arrangement using two electrothermal transducer elements as shown in FIG. 1 will be described. Selecting electrodes, i.e., wiring electrodes 8 and 9 and a common electrode 10 in the form of layers are formed on a heating resistor layer. Regions between these electrodes are defined as heating regions of two electrothermal transducer elements 4 and 6. Electric signals (drive signals) are selectively applied to the selecting electrodes 8 and 9 to generate heat in the heating regions of the electrothermal transducer elements independently or simultaneously.

According to the present invention, the distances from the ejection opening to centroids ($C_A$, $C_B$) of the heating regions of the electrothermal transducer elements are set so as to be equal or nearly equal to each other. The difference between these distances is 3 μm or less. If the difference is larger than this value, a need for considering the difference between ejection amounts due to the difference between the distances between the heating regions and the ejection opening arises. In this example, the two electrothermal transducer elements disposed in one flow passage (nozzle) differ from each other in heating area.

The heating region of the smaller electrothermal transducer element 4 has an area $Sh_A$ while the heating region of the larger electrothermal transducer element 6 has an area $Sh_B$. The selecting wiring electrodes 8 and 9 are connected to the electrothermal transducer elements 4 and 6, respectively, and the common wiring electrode 10 is connected to the same on the side opposite from the selecting wiring electrodes 8 and 9. A switching means such as a transistor is connected to the ends of the wiring electrodes 8 and 9 remote from the electrothermal transducer elements 4 and 6. The switching means selectively drives the electrothermal transducer elements 4 and 6 to eject ink contained in the nozzle.

In this example, the areas $Sh_A$ and $Sh_B$ of the electrothermal transducer elements 4 and 6 were set to 1445 $\mu m^2$ and 2210 $\mu m^2$, respectively, and the amounts of ejection by the electrothermal transducer elements 4 and 6 were set to $Vd_A$=15 ng and $Vd_B$=30 ng, respectively. The head was manufactured so that the ratio of the ejection amounts, i.e., $Vd_B/Vd_A$=2.0, is larger than the ratio of the areas, i.e., $Sh_B/Sh_A$=1.53, that is, $Vd_B/Vd_A > Sh_B/Sh_A$.

TABLE 1

| $Vd_A$ | $Vd_B$ | $Vd_B/Vd_A$ | $Sh_A$ | $Sh_B$ | $Sh_B/Sh_A$ |
|---|---|---|---|---|---|
| 15 ng | 30 ng | 2.0 | 1445 $\mu m^2$ | 2210 $\mu m^2$ | 1.53 |

That is, the head was designed by considering the fact that bubble generating regions 5 and 7 (in the areas indicated by the broken line) through which bubbles are generated in ink and non-bubble-generating regions through which no bubbles are generated in ink exist in the heating regions of the electrothermal transducer elements because of a heat distribution as described above. If such ratios are selected, each of different required amounts of ink can be ejected stably.

Figure 2A:
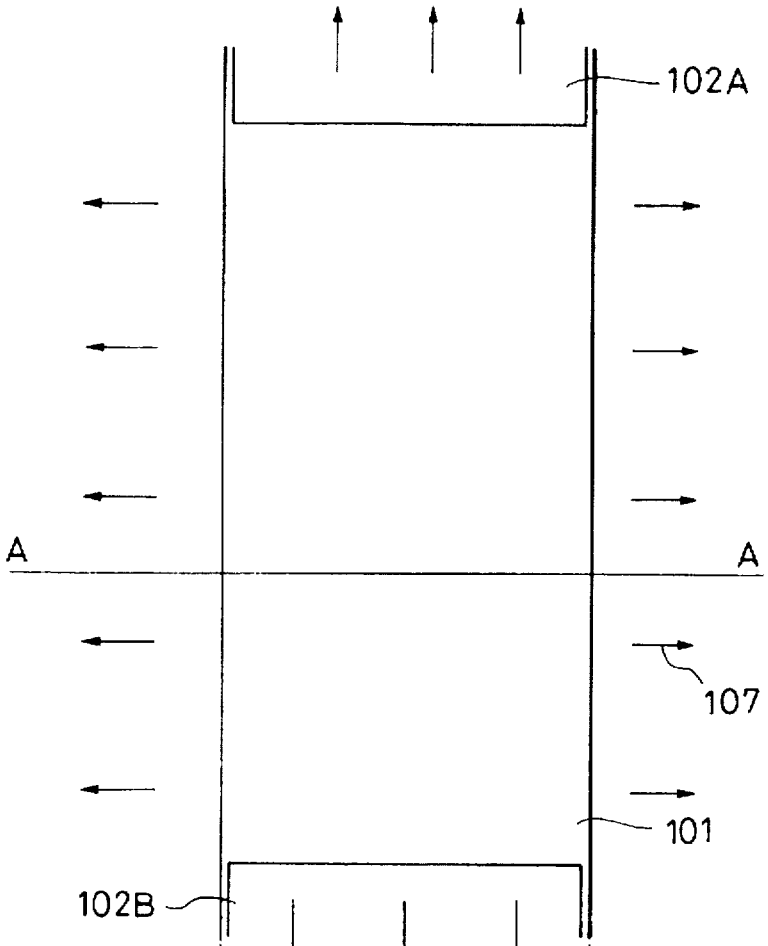
FIGS. 2(*a*) and 2(*b*) are a diagram of a bubble generating region of one electrothermal transducer element.
Figure 2B:
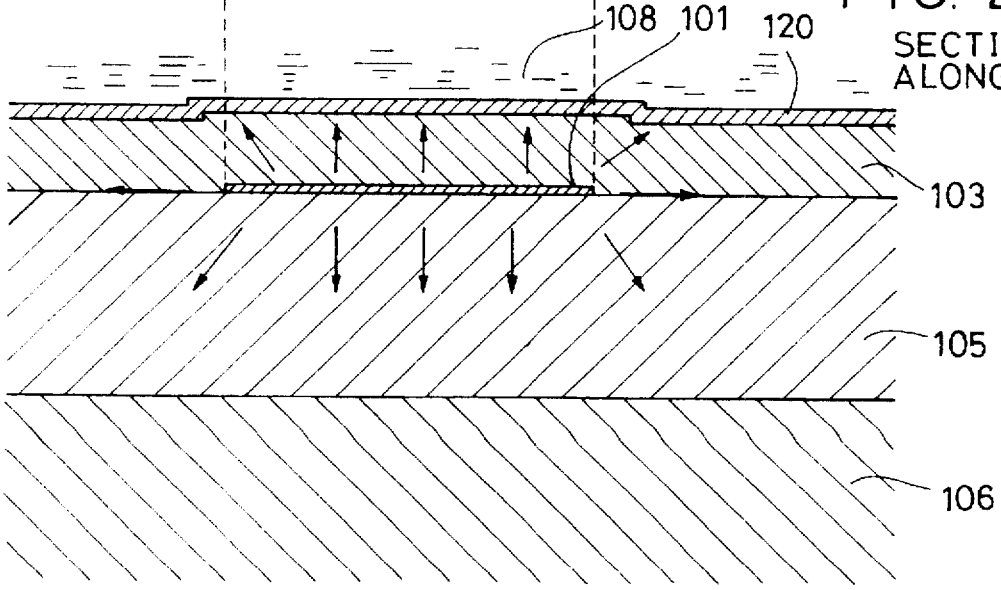
Figure 3:
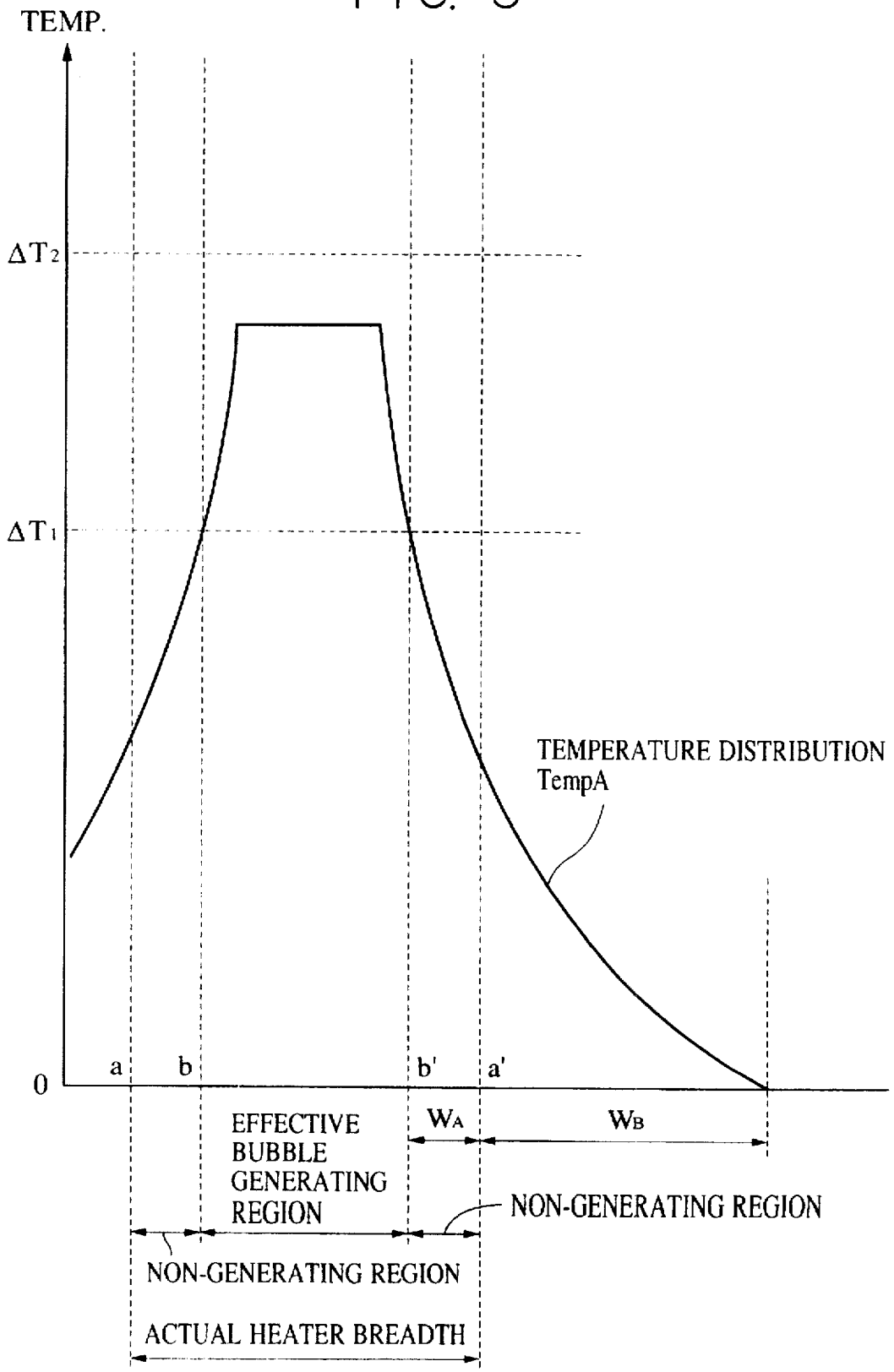
FIG. 3 is a diagram of a surface temperature distribution in one electrothermal transducer element.

The bubble generating regions existing in the electrothermal transducer elements will be described briefly with reference to FIG. 2. The film structure of the electrothermal transducer elements used in accordance with the present invention is such that a heat accumulating layer 105 formed of an insulating material such as $SiO_2$ is formed on a silicon substrate 106 having a thickness of about 500 to 600 μm, and a resistor layer 101 is formed and patterned on the heat accumulating layer 105. A protective layer 103 formed of an insulating material such as $SiO_2$ or SiN and a cavitation proofing layer 120 which absorbs impulse waves caused by growth and collapse of a bubble are formed over the resistor layer 101. A voltage is applied to the resistor layer 101 through wiring electrodes 102A and 102B voltages to produce a current for heating. Heat generated in the resistor layer escapes in the direction of superposition of the films at a central portion of the electrothermal transducer element, but also escapes in the film spreading direction at each end of the electrothermal transducer element. In the surface of the electrothermal transducer element in contact with ink, therefore, the temperature is lower at each end of the electrothermal transducer element than at the central portion. In such a situation, the electrothermal transducer element has, along the line A—A, a surface temperature distribution such as represented by a temperature distribution Temp A shown in FIG. 3. It can be understood from FIG. 3 that a uniform temperature distribution is exhibited at the center of the electrothermal transducer element because the heat escapes in the film superposing direction, and that the temperature becomes lower at a position closer to each end because the heat escapes in the film spreading direction. In FIG. 3, ΔT1 represents a lower limit temperature at which a bubble can be formed in ink on the electrothermal transducer element, and ΔT2 represents a temperature at which the electrothermal transducer element is excessively heated and damaged by thermal stress or the like so that its life becomes very short. Accordingly, as long as the temperature of the electrothermal transducer element is stably controlled at a bubble generating temperature such as to avoid a considerable reduction in life, a non-generating region where the temperature is lower than the minimum bubble generating temperature exists in a peripheral portion of the electrothermal transducer element, as shown in FIG. 3.

It is particularly necessary to adopt the above-described design considering a non-generating region if the length of the periphery of an electrothermal transducer element is substantially large in comparison with the area of the electrothermal transducer element as in a case where a plurality of electrothermal transducer elements are disposed in one liquid passage, as in the present invention. The present invention has been achieved by considering such a non-bubble-generating region.

(Example 2)

A head was constructed in substantially the same manner as the head of Example 1. In this example, the areas of the heating regions of the electrothermal transducer elements 4 and 6 were set to $Sh_A$=2520 $\mu m^2$ and $Sh_B$=5580 $\mu m^2$, respectively, and the amounts of ejection by the electrothermal transducer elements 4 and 6 were set to $Vd_A$=40 ng and $Vd_B$=120 ng, respectively.

In this example, the ratio of the ejection amounts and the ratio of the areas of the heating regions of the electrothermal transducer elements are $Vd_B/Vd_A$=3.0 and $Sh_B/Sh_A$=2.3, respectively, and the condition $Vd_B/Vd_A > Sh_B/Sh_A$ in accordance with the present invention is satisfied. Also in this example, the head can stably eject the desired amount of ink.

(Comparative Example)

A head was constructed in substantially the same manner as the head of Example 1. In this example, the areas of the heating regions of the electrothermal transducer elements 4 and 6 were set to $Sh_A$=40×60=2400 $\mu m^2$ and $Sh_B$=20×200=4000 $\mu m^2$, respectively, and the ejection amounts were set to $Vd_A$=42 ng and $Vd_B$=158 ng, respectively.

In this example, the ratio of the ejection amounts and the ratio of the areas of the heating regions of the electrothermal transducer elements are $Vd_B/Vd_A$=1.38 and $Sh_B/Sh_A$=1.66, so that $Vd_B/Vd_A < Sh_B/Sh_A$, that is, the condition of the present invention is not satisfied.

In such a case, suitable drive voltages are about 10 V and 33 V if the drive pulse width is constant. Driving by such voltages is disadvantageous in terms of drive energy efficiency, and it is difficult to stably maintain the desired amounts of ejection by the electrothermal transducer elements.

Figure 4:
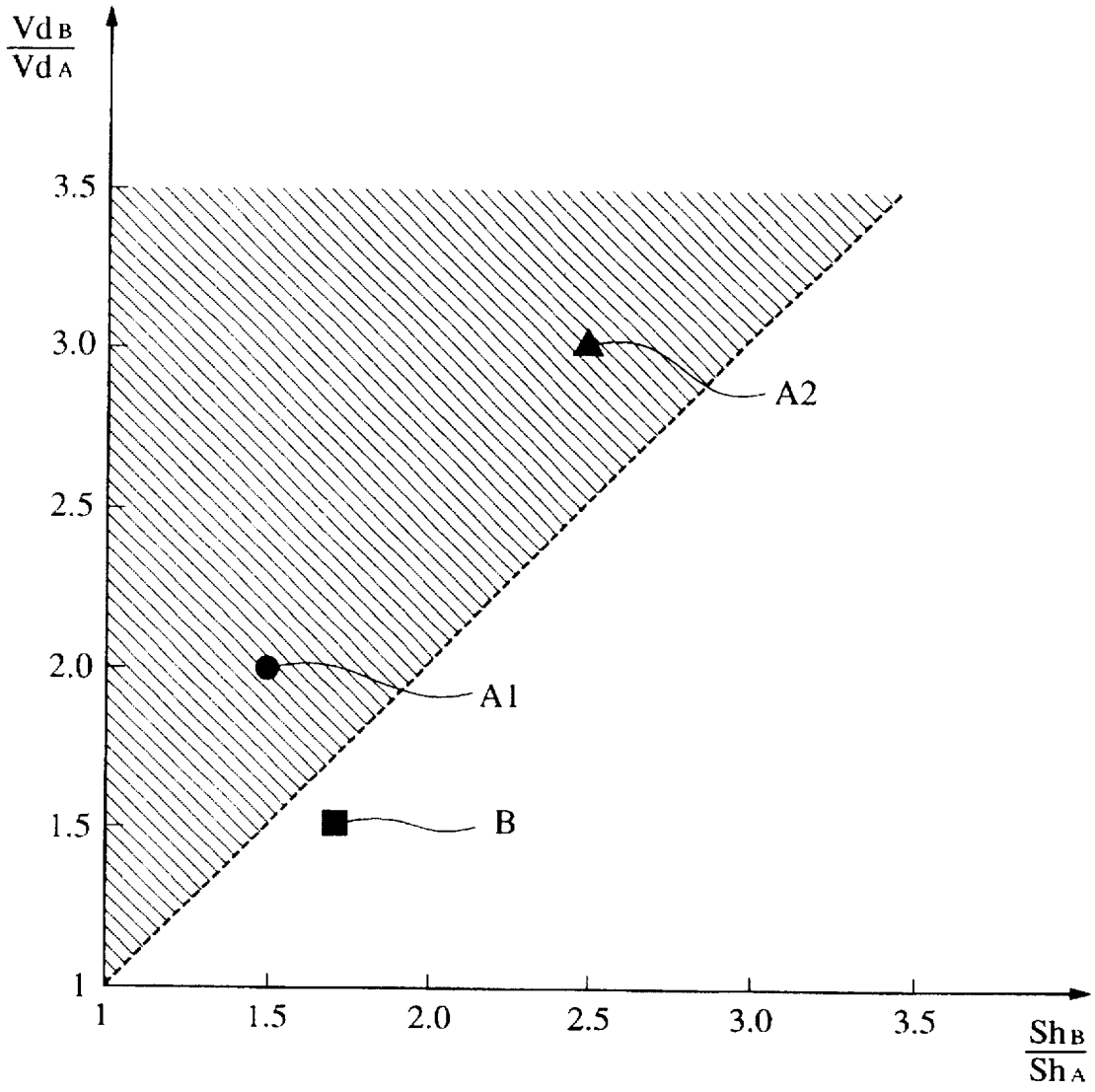
FIG. 4 is a graph of the ejected volume ratio with respect to the area ratio of one electrothermal transducer element.
Figure 5A:
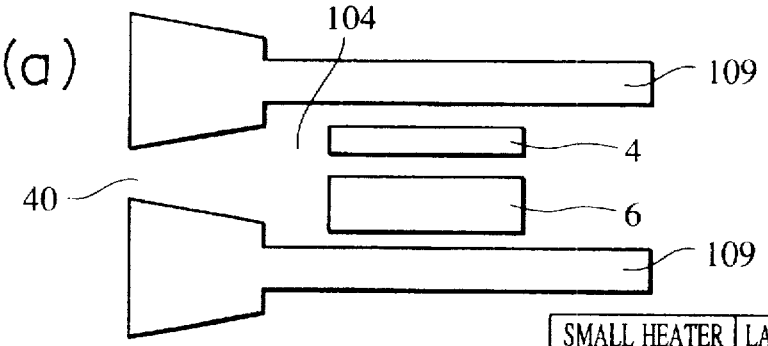
FIGS. 5(*a*) to 5(*d*) are diagrams showing driven states of the ink jet head of the present invention.
Figure 5B:
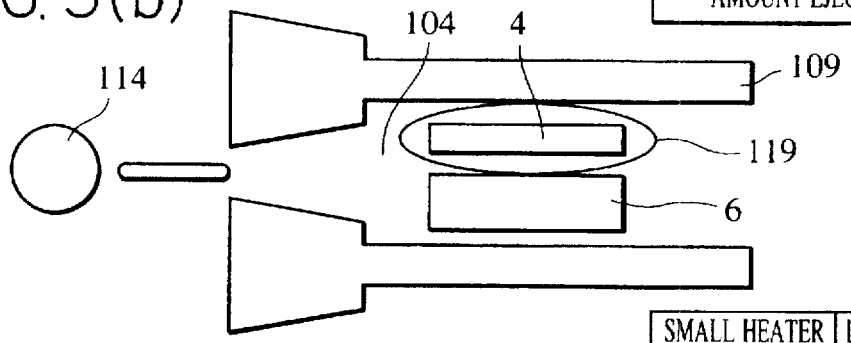
Figure 5C:
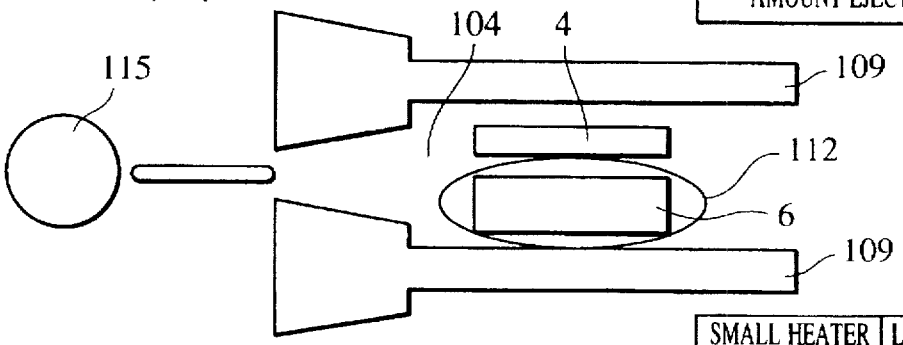
Figure 5D:
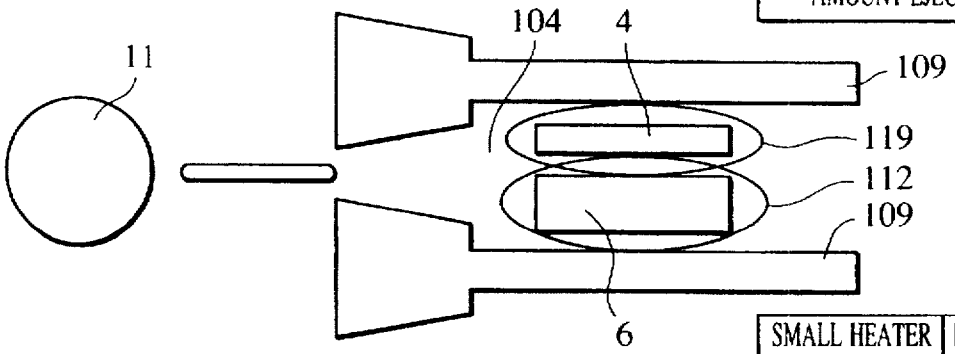

FIG. 4 is a graph of the ratio of the areas of the heating regions of each of the electrothermal transducer elements of the above-described examples (Example 1: A1, Example 2: A2) and the comparative example (B) (on the abscissa) with respect to the ratio of the ejection amounts (on the ordinate).

The broken line designates the case where the area ratio and the ejection amount ratio are equal to each other. The area ratio-ejection amount ratio relationship of each of Example 1(A1) and Example 2(A2) is indicated in the hatched area defined in accordance with the present invention. In the case of Example 1 or 2, the desired amount of liquid can be stably ejected by each electrothermal transducer element, and the ejection characteristics are advantageous in terms of drive energy efficiency.

On the other hand, the area ratio-ejection amount ratio relationship of the comparative example (B) is out of the area in accordance with the present invention. As mentioned above, in the comparative example, it is difficult to stably eject the desired amount of liquid, and the ejection characteristics are disadvantageous in terms of drive energy efficiency.

The condition of the present invention is particularly effective when the distances of the centroid positions of the electrothermal transducer elements, i.e., the distances $OC_A$ and $OC_B$ of the centroids $C_A$ and $C_B$ of the electrothermal transducer elements 4 and 5 shown in FIG. 1 from the orifice surface are approximately equal to each other (the error is not larger than a manufacturing variation of about 3 μm). Also, it is more desirable that the materials, the film thicknesses and drive conditions of the electrothermal transducer elements are substantially equal to each other.

In the examples of the present invention, the width $W_A(d)$ of the above-described non-bubble-generating region of the electrothermal transducer element is about 3 to 5 μm. The width $W_A(d)$, however, varies depending upon the structure and materials of the films and drive conditions. It is necessary to consider the possibility of the width $W_A(d)$ ranging from about 0.1 to 10 μm under some condition. An optimal condition of $Vd_B/Vd_A>Sh_B/Sh_A$ is obtained by considering these conditions, as described below. If the width and length of the smaller and larger electrothermal transducer elements are, $Wh_A$ and $Lh_A$, and $Wh_B$ and $Lh_B$, respectively, then $Vd_B/Vd_A=((Wh_B-2W_A)\times(Lh_B-2W_A))/((Wh_A-2W_A)\times(Lh_A-2W_A))$ is established in theory. When the widths and lengths of the electrothermal transducer elements are indefinite, $Vd_B/Vd_A=(Sh_B-L_B\times W_A)/(Sh_A-L_A\times W_A)$ is established in theory where $L_A$ and $L_B$ are the lengths of the peripheries (indicated by the broken lines in FIG. 1) of the regions defined inside the electrothermal transducer elements 4 and 5 at a distance of $W_A/2$ from the peripheries of the same. If the electrothermal transducer elements are designed under this design condition, the ratio of the desired ejection amounts can easily be set. Actually, the electrothermal transducer elements are ordinarily designed so as to be approximately equal in length in order to equalize conditions of driving them. Accordingly, the terms including the lengths of the electrothermal transducer elements in the above relational equation can be eliminated to obtain a simpler relational equation: $Vd_B/Vd_{A=(Wh_B\Delta 2W_A)}/(Wh_A-2W_A)$. Even if the lengths of the electrothermal transducer elements differ from each other, they are so large in comparison with $W_A$ that the resulting error is negligibly small.

If the ejection amount ratio of the electrothermal transducer elements is set by the above-described method, the adjustment of the overall ejection amount and so on may be performed in a later step of setting the orifice area or positioning the electrothermal transducer elements with respect to the nozzle, as mentioned above, thus facilitating designing and manufacturing.

Gradation control using the above-described head will next be described briefly with reference to FIGS. 5(*a*) to 5(*d*).

Figure 6:
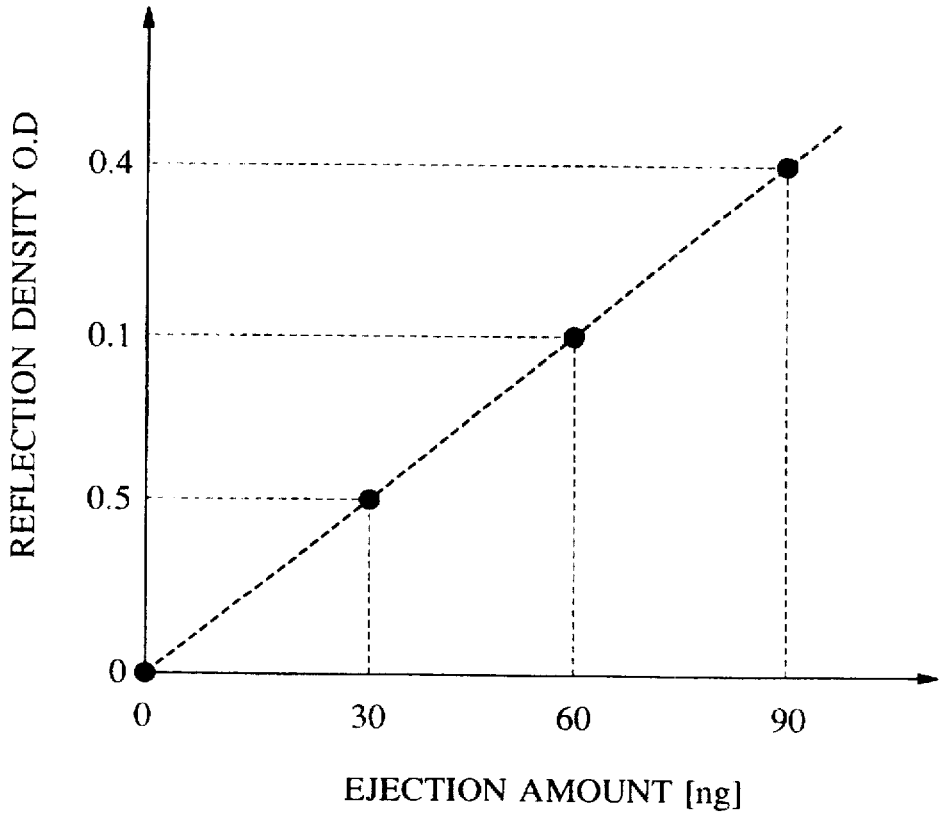
FIG. 6 is a graph of the relationship between the ejection amount and the reflection density.

Ejection nozzle 104 interposed between nozzle walls 109 as shown in FIG. 5(*a*) is filled with ink. A drive signal is applied to each of the electrothermal transducer elements 4 and 6 to heat ink so that a bubble is generated in ink. Ink is ejected through orifice 40 by a pressure caused by the growth of the bubble. FIG. 5(*b*) shows a state in which the smaller electrothermal transducer element 4 is heated to generate a smaller bubble 119, whereby a smaller droplet 114 is ejected. It is assumed here that the ejection amount at this time is 30 ng. FIG. 5(*c*) shows a state in which the larger electrothermal transducer element 6 is heated to generate a larger bubble 112, whereby a larger droplet 115 is ejected. If the larger electrothermal transducer element 6 is designed to have an effective bubble generating area twice that of the smaller electrothermal transducer element 4, the amount of ejection by the larger electrothermal transducer element 6 is about 60 ng since the ejection amount is proportional to the effective bubble generating area. FIG. 5(*d*) shows a state in which both the electrothermal transducer elements are heated to generate bubbles. In this event, the total ejection amount is the sum of the amounts of ejection by the two electrothermal transducer elements, i.e., 90 ng. FIG. 6 shows reflection densities obtained when an image is formed by ejecting these amounts of ink. Because the density is proportional to the amount of ink ejected, three densities are obtained. That is, four-value gradation control is realized by using two electrothermal transducer elements of different sizes. The importance of the ejection amount ratio described above is apparent from this example of gradation control. If the balance of these ejection amounts is lost, the linearity of gradation control is reduced.

Figure 7:
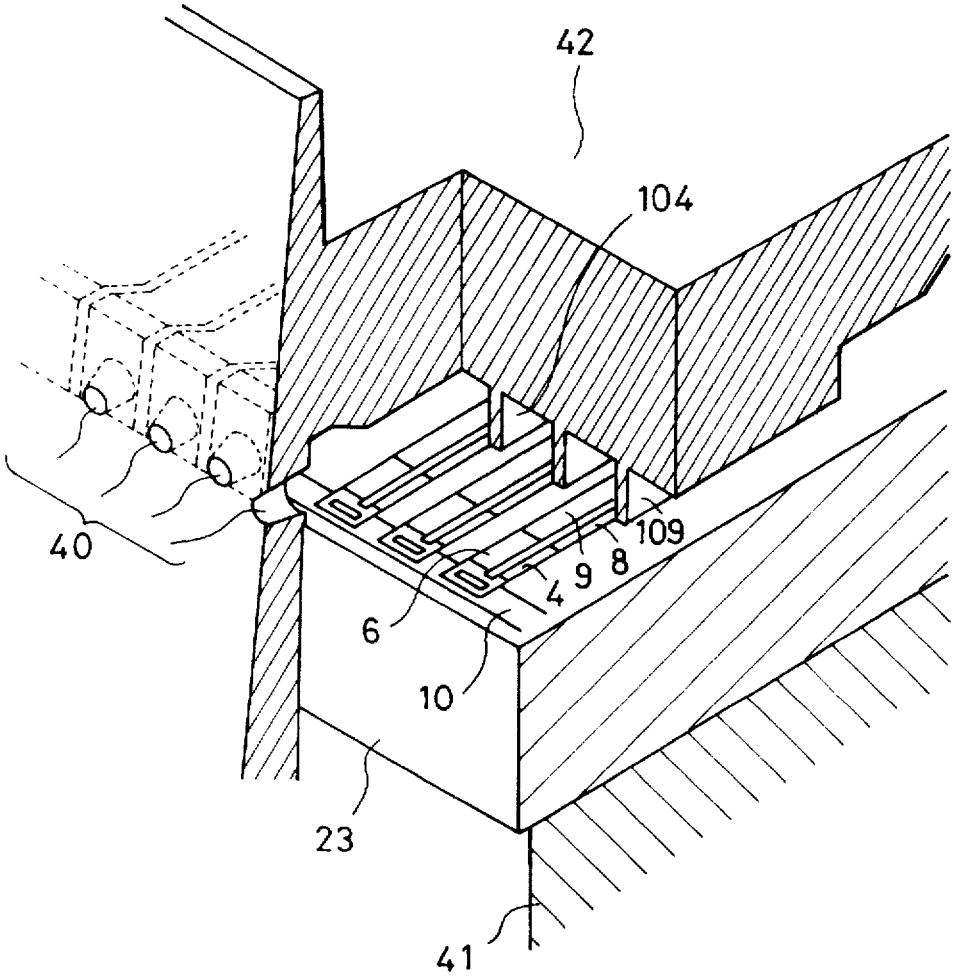
FIG. 7 is a schematic diagram of an example of the head structure of the present invention.
Figure 8:
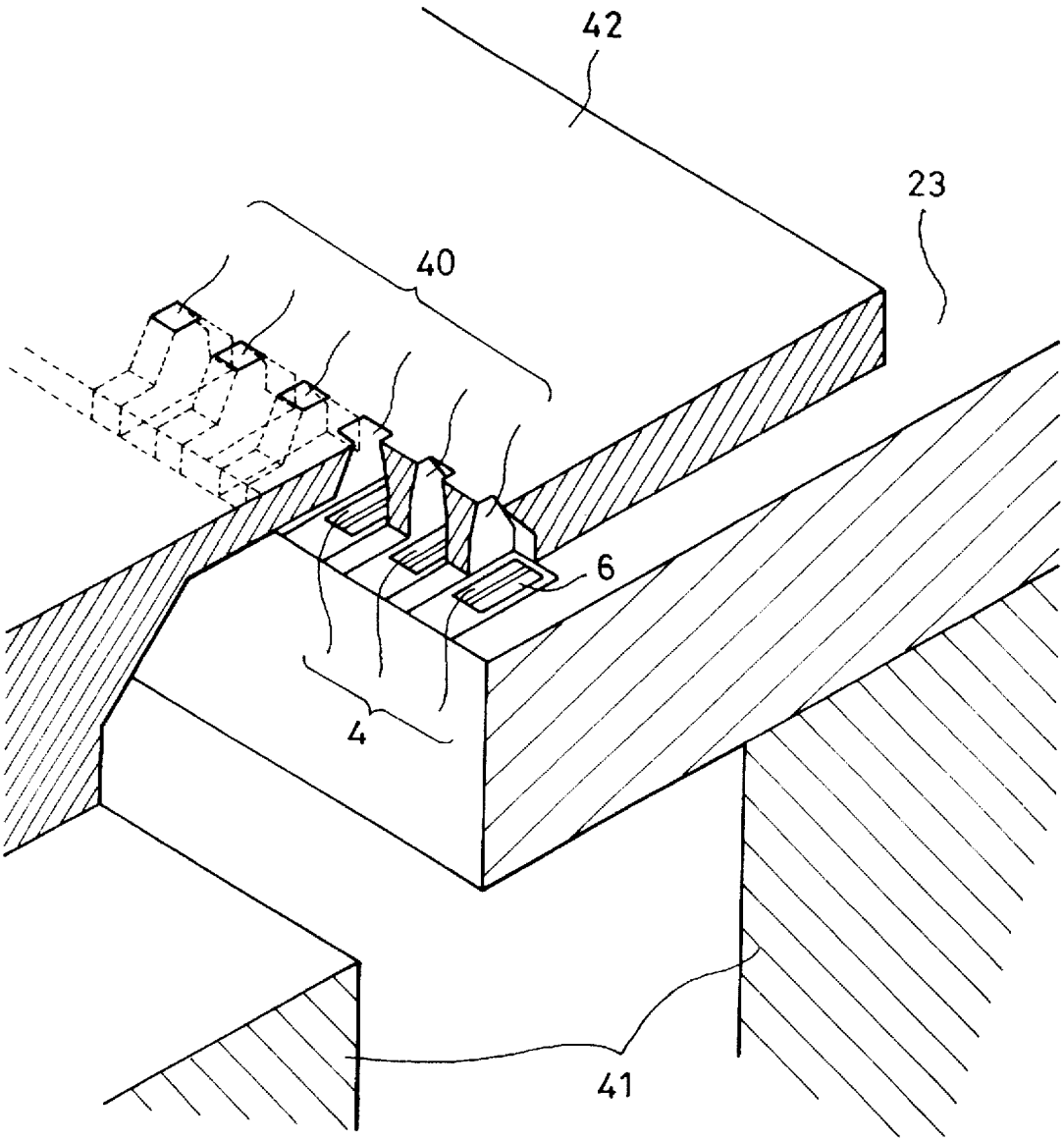
FIG. 8 is a schematic diagram of another example of the head structure of the present invention.

The construction of the above-described head will be further described. FIGS. 7 and 8 show examples of the construction of nozzles and portions round the nozzles, i.e., an edge shoe type construction and a side shoe type construction. Ink in each of ejection nozzles 104 is heated by one or both of electrothermal transducer elements 4 and 6 to form a bubble, thereby ejecting ink through orifice 40 which is open in a lateral or upward direction. An element substrate 23 is bonded to a base plate 41. Nozzle walls 109 are provided on a ceiling plate 42.

Figure 9:
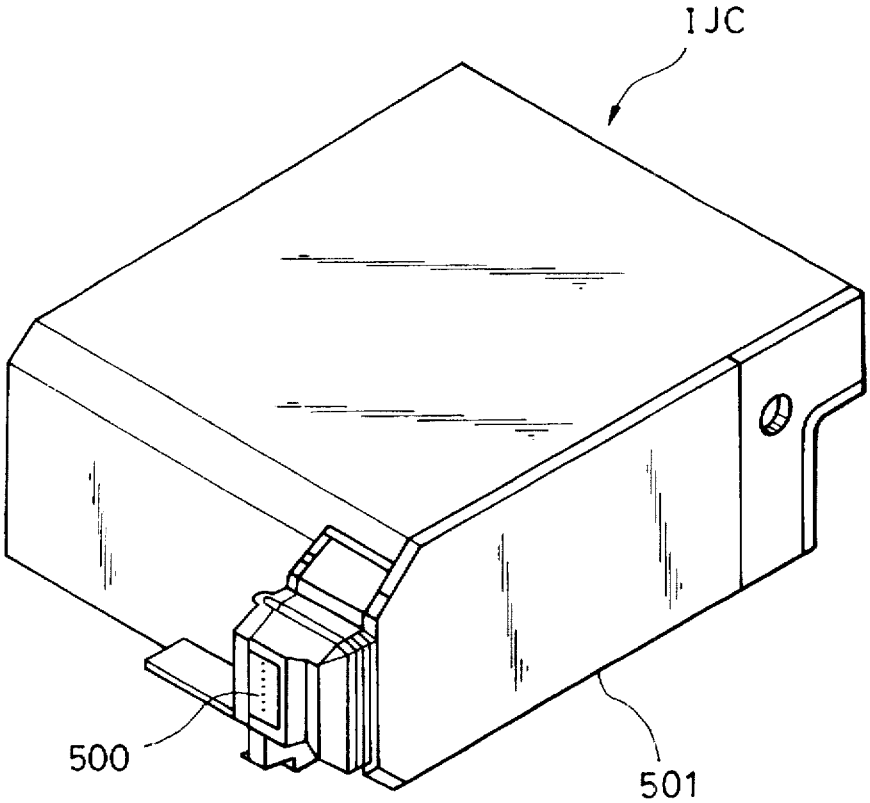
FIG. 9 is a schematic illustration of an ink head cartridge using the ink jet head of the present invention.

FIG. 9 shows an ink jet head cartridge in which the ink jet head (liquid jet head) of the present invention and an ink container containing ink to be supplied to the ink jet head are separably connected to each other.

Ink is injected into the ink tank constituting this ink jet head cartridge in a manner described below.

An ink supply pipe or the like is connected to the ink container to form an ink introduction passage, and ink is injected into the ink container through this ink introduction passage. As an ink supply port of the ink container, a supply port to the ink jet head, an atmospheric air opening, a hole formed in a wall portion of the ink container or the like may be used.

Figure 10:
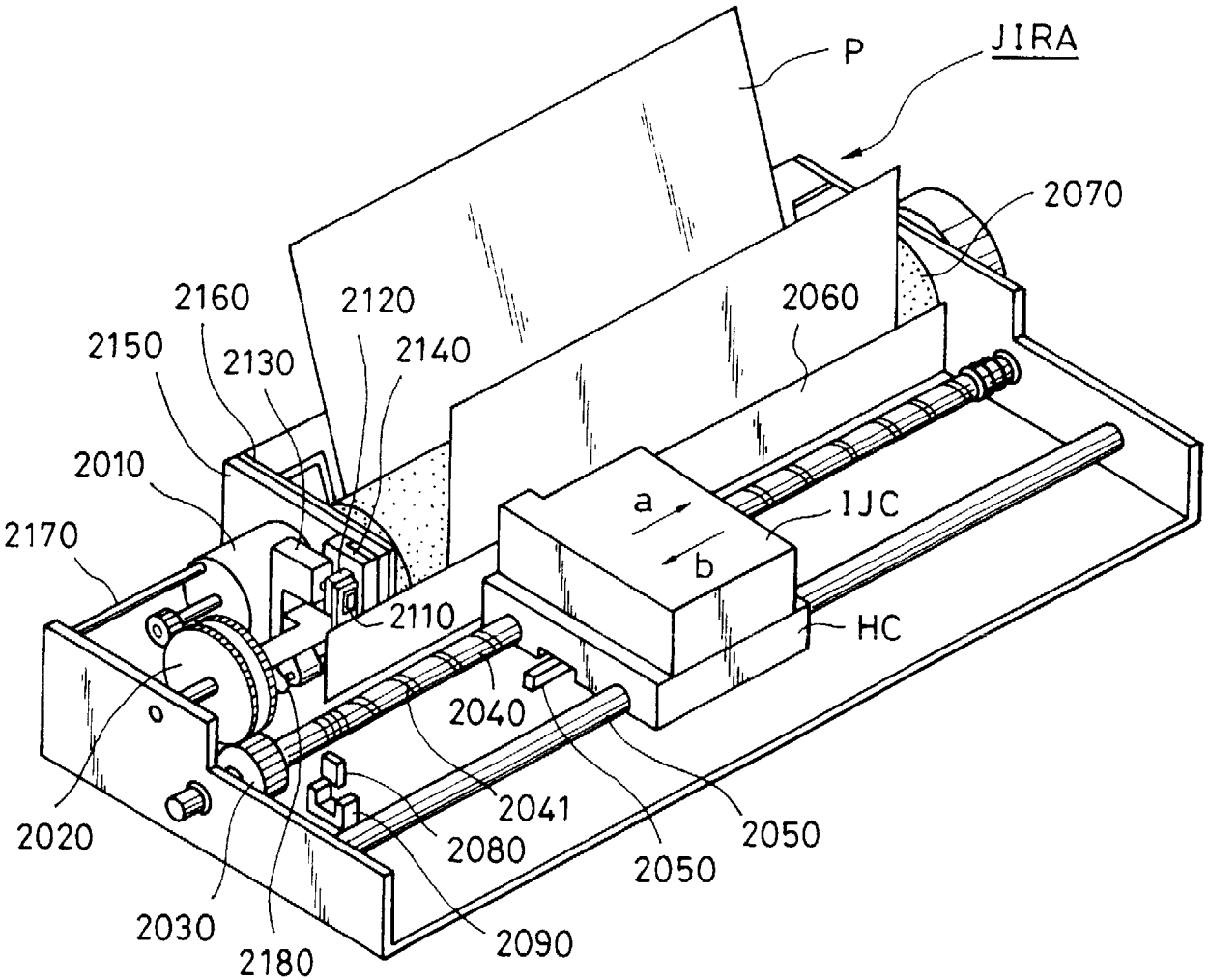
FIG. 10 is an illustration of an ink jet apparatus of the present invention.

FIG. 10 shows an example of an ink jet recording apparatus IJRA in which the ink jet recording head arranged as described above is mounted. The ink jet recording apparatus IJRA has a lead screw 2040 which rotates by being linked to the rotation of a drive motor 2010 in the normal and reverse directions through driving force transmission gears 2020 and 2030. A carriage HC which supports an ink jet cartridge IJC in which the ink jet recording head and an ink tank are combined integrally with each other is supported by a carriage shaft 2050 and a lead screw 2040, has a pin (not shown) engaging with a helical groove 2041 of the lead screw 2040, and moves reciprocatingly in the directions of arrows a and b. A paper retaining plate 2060 presses a paper sheet P against a platen roller 2070 through a carriage traveling width. The platen roller 2070 constitutes a transport means for transporting paper P, i.e., a recording medium. Photocouplers 2080 and 2090 operate as home position detection means to confirm the existence of a lever 2100 of the carriage HC in their region to perform an operation of changing the direction of rotation of the motor 2010 or the like. A member 2120 supports a cap member 2110 for capping a front side of the recording head. A drawing means 2130 for evacuating the interior of the cap is used for drawing recovery of the recording head through an internal cap opening. A cleaning blade 2140 for cleaning the end surface of the recording head is provided on a member 2150 which is movable forward and rearward. The cleaning blade 2140 and the member 2150 are supported on a main body supporting plate 2160. Needless to say, any other well-known cleaning blade can be applied to this apparatus in place of the cleaning blade 2140. A lever 2170 is used to start drawing for drawing recovery. The lever 2170 moves with the movement of a cam 2180 engaging with the carriage HC, and the transmission of the driving force from the drive motor 2010 is controlled by a well-known transmission means such as a clutch.

For each of the above-mentioned capping, cleaning and drawing recovery operations, the desired processing can be started at the corresponding position through the operation of the lead screw 2040 when the carriage HC moves into a region on the home position side. Any of these kinds of functions can be applied to this apparatus if the desired operation can be performed by a well-known timing.

This apparatus also has a drive signal supply means for supplying a signal for driving the heating resistors, i.e., electrothermal transducers of the ink jet head of the present invention.

The ink jet head of the present invention has been described with respect to two electrothermal transducer elements in one nozzle. Needless to say, even if three or more electrothermal transducer elements are provided in one nozzle, the relationship between the ejection amount ratio and the area ratio in accordance with the above-described relational equation is established with respect to each of the electrothermal transducer elements.

As described above, the ratio of the amount of ejection by a plurality of electrothermal transducer elements and the ratio of the areas of the electrothermal transducer elements are set with a suitable relationship to obtain desired ejection amounts, thereby enabling high-linearity gradation control.

While the present invention has been described with respect to what presently are considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid jet head comprising:

a liquid passage having an ejection opening for ejecting a liquid; and a plurality of electrothermal transducer elements provided at said liquid passage, each said electrothermal transducer element having an area, a length and a width, said electrothermal transducer elements being disposed at nearly equal or equal distances from the ejection opening, wherein, if the areas of two of said electrothermal transducer elements are Sh1 and Sh2 (Sh1>Sh2) and an amount of ink ejected by each of said two electrothermal transducer elements is Vd1 and Vd2, respectively, then Vd1/Vd2>Sh1/Sh2 is satisfied.

2. A liquid jet head according to claim 1, wherein the lengths of said two electrothermal transducer elements are approximately equal to each other, and wherein, if the widths of said two electrothermal transducer elements are W1 and W2 and a width of a non-bubble-generating region is d, then Vd1/Vd2 is substantially equal to (W1–2d)/(W2–2d).

3. A liquid jet head according to claim 1, wherein if the widths of said two electrothermal transducer elements are W1 and W2, the length of said two electrothermal transducer elements are L1 and L2 and a width of a non-bubble-generating region is d, then Vd1/Vd2 is substantially equal to (W1–2d)×(L1–2d)/(W2–2d)×(L2–2d).

4. A liquid jet head according to claim 1, wherein a difference between the distances between the position at which said ejection opening is formed and said plurality of electrothermal transducer elements provided so as to face said liquid passage is not larger than 3 μm.

5. A liquid jet head according to claim 1, wherein a number of electrothermal transducer elements provided so as to face said liquid passage is two.

6. A liquid jet head according to claim 1, wherein said liquid is an ink.

7. A head cartridge comprising:

a liquid jet head according to claim 1; and a liquid container for containing a liquid to be supplied to said liquid jet head.

8. A head cartridge according to claim 7, wherein said liquid jet head and said liquid container are detachably attached to each other.

9. A head cartridge according to claim 7, wherein said liquid is an ink.

10. A liquid jet apparatus comprising:

a liquid jet head according to claim 1; and transport means for transporting a recording medium.

11. A liquid jet apparatus comprising:

a liquid jet head according to claim 1; and drive signal supply means for driving said liquid jet head.

12. A liquid jet recording method comprising the steps of:

providing a liquid jet head having a liquid passage having an ejection opening for ejecting a liquid, and a plurality of electrothermal transducer elements provided at said liquid passage, the electrothermal transducer elements being disposed at nearly equal or equal distances from the ejection opening, two of the electrothermal transducer elements having areas Sh1 and Sh2 (Sh1>Sh2); and applying drive signals to the electrothermal transducer elements so that a given said electrothermal transducer element corresponding to Sh1 ejects an amount Vd1 of the liquid while a given said electrothermal transducer element corresponding to Sh2 elects an amount Vd2 of the liquid, wherein Sh1, Sh2, Vd1 and vd2 satisfy Vd1/Vd2>Sh1/Sh2.

13. A method of injecting a liquid into a liquid container comprising the steps of:

forming at least one liquid introduction passage for introducing a liquid into a liquid container constituting a head cartridge according to claim 7; and injecting the liquid into the liquid container through the liquid introduction passage.

14. A method according to claim 13, wherein said liquid is an ink.

* * * * *

UNITED STATES PATENT AND TRADEMARK OFFICE

CERTIFICATE OF CORRECTION

PATENT NO. : 5,754,201

DATED : May 19, 1998

INVENTOR(S) : HIROYUKI ISHINAGA, ET AL.

It is certified that error appears in the above-identified patent and that said Letters Patent is hereby corrected as shown below:

COLUMN 7

Line 48, "$Vd_B/Vd_{A=(WhB}\Delta 2W_A)/(Wh_A$-" should read --$Vd_B/Vd_A=(Wh_B-2W_A)/(Wh_A$- --.

COLUMN 10

Line 55, "vd 2" should read --Vd2--.

Signed and Sealed this

Twenty-ninth Day of December, 1998

*Attest:*

*Attesting Officer*

Bruce Lehman

BRUCE LEHMAN

*Commissioner of Patents and Trademarks*